US005398896A

United States Patent [19]

Terbrack

[11] Patent Number: 5,398,896

[45] Date of Patent: Mar. 21, 1995

[54] DYNAMIC SUPPORT DEVICE FOR KEYBOARDS

[76] Inventor: William H. Terbrack, 32121 Fall River Rd., Trabuco Canyon, Calif. 92679

[21] Appl. No.: 103,432

[22] Filed: Aug. 6, 1993

[51] Int. Cl.[6] ..... B43L 15/00

[52] U.S. Cl. ..... 248/118.5; 248/118; 248/918; 400/715

[58] Field of Search ..... 248/118, 118.3, 297.3, 248/298, 118.1, 918, 118.5; 400/715; 340/711

[56] References Cited

U.S. PATENT DOCUMENTS

| | | | |
|---|---|---|---|
| 607,675 | 7/1898 | Barr | 248/118.1 |
| 3,191,994 | 6/1965 | Boyce . | |
| 4,378,553 | 3/1983 | McCall . | |
| 4,670,743 | 6/1987 | Zemke . | |
| 4,688,862 | 8/1987 | Fowler et al. . | |
| 4,709,972 | 12/1987 | LaBudde et al. . | |
| 4,769,517 | 9/1988 | Swinney . | |
| 5,050,826 | 9/1991 | Johnston . | |
| 5,056,743 | 10/1991 | Zwar | 248/118 |
| 5,108,057 | 4/1992 | Dandy | 248/118 |
| 5,145,270 | 9/1992 | Darden | 400/715 X |
| 5,158,256 | 10/1992 | Gross | 400/715 X |
| 5,161,760 | 11/1992 | Terbrack | 340/711 X |
| 5,242,139 | 9/1993 | Aldrich | 400/715 X |
| 5,281,001 | 1/1994 | Bergsten | 248/118 X |

*Primary Examiner*—J. Franklin Foss
*Attorney, Agent, or Firm*—Stetina Brunda & Buyan

[57] ABSTRACT

A keyboard, forearm, wrist and hand support device for use in conjunction with the keyboard of a video display terminal work station. The support device is adapted to reduce occurrences of repetitive strain injury by reducing stress on the user's shoulders, arms, wrists and hands. The support device comprises an elongate guide track and a pair of support assemblies which are adapted to support a user's forearms, wrists and hands thereon. Each of the support assemblies comprises a carriage member slidably engaged to the guide track and a linkage member pivotally connected to the carriage member. Pivotally connected to the linkage member is a support member which is sized and configured to support the user's forearm and wrist and the palmar surface of the user's hand. The pivotal connection of the carriage and support members to the linkage member and the slidable engagement of the carriage member to the guide track facilitates dynamic lateral and longitudinal movement of the support member and hence the user's hands relative the guide track.

17 Claims, 5 Drawing Sheets

Fig. 1
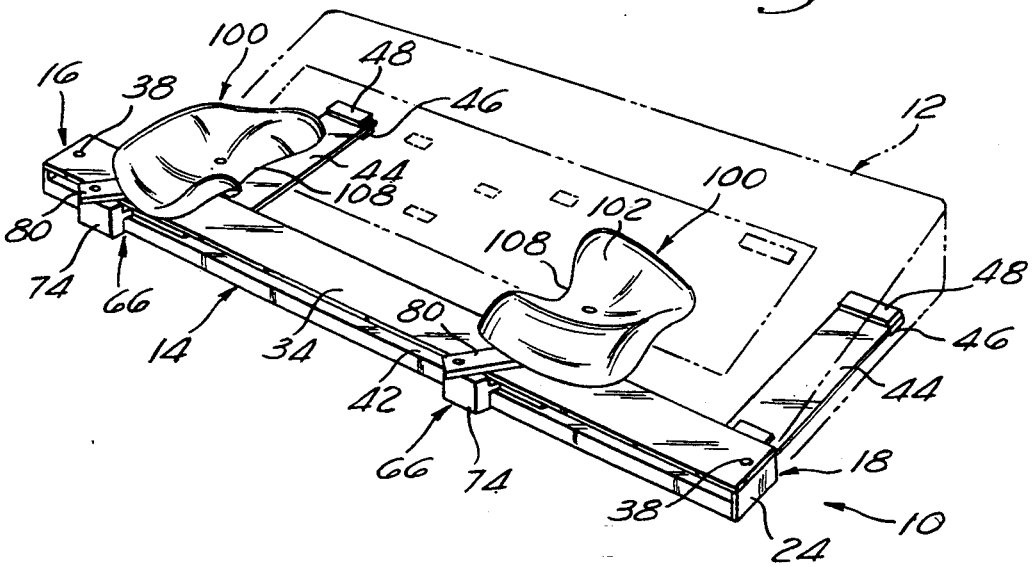
Fig. 2
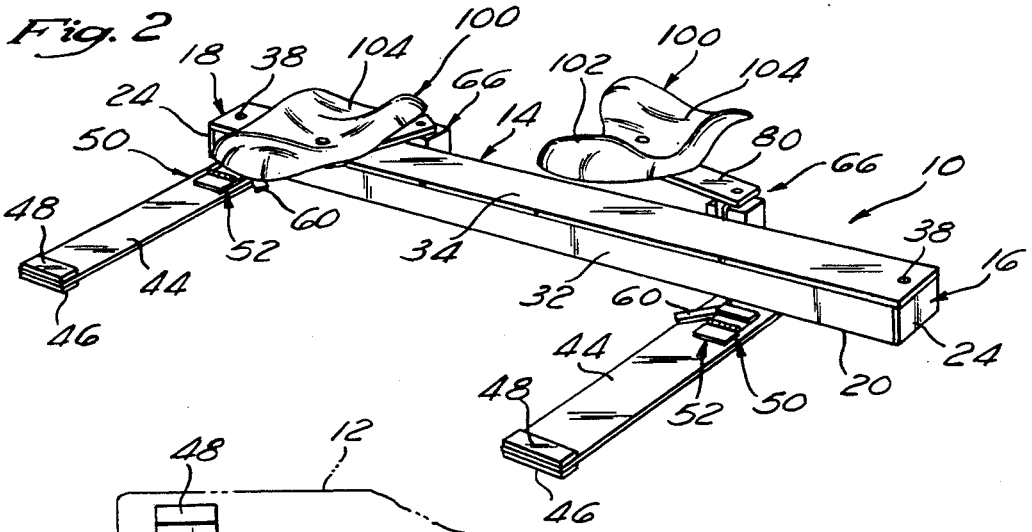
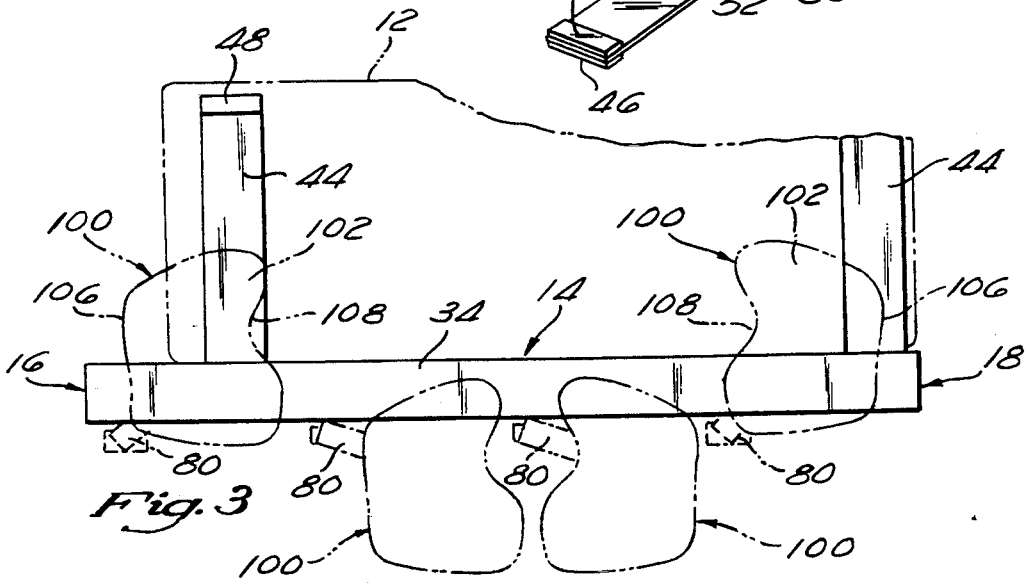
Fig. 3

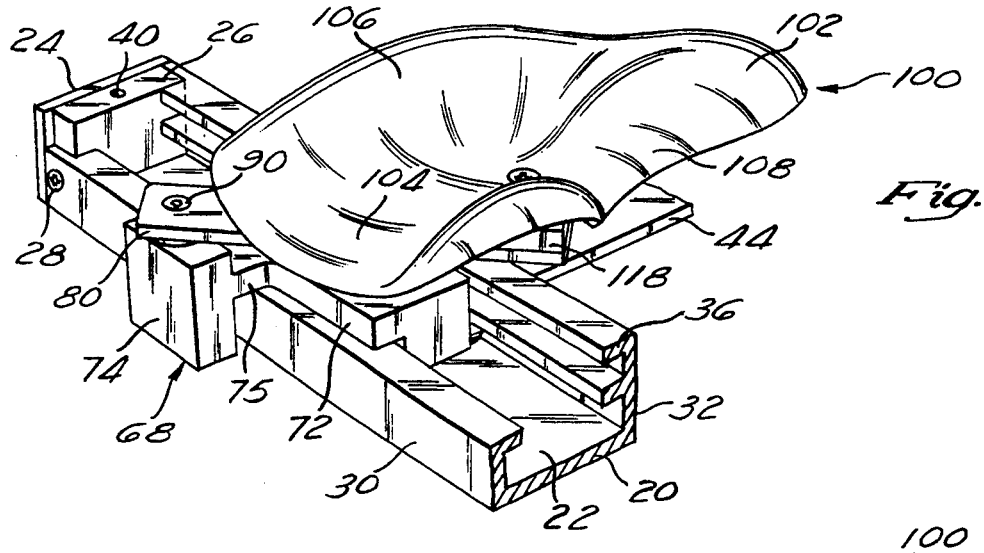
Fig. 4
Fig. 5
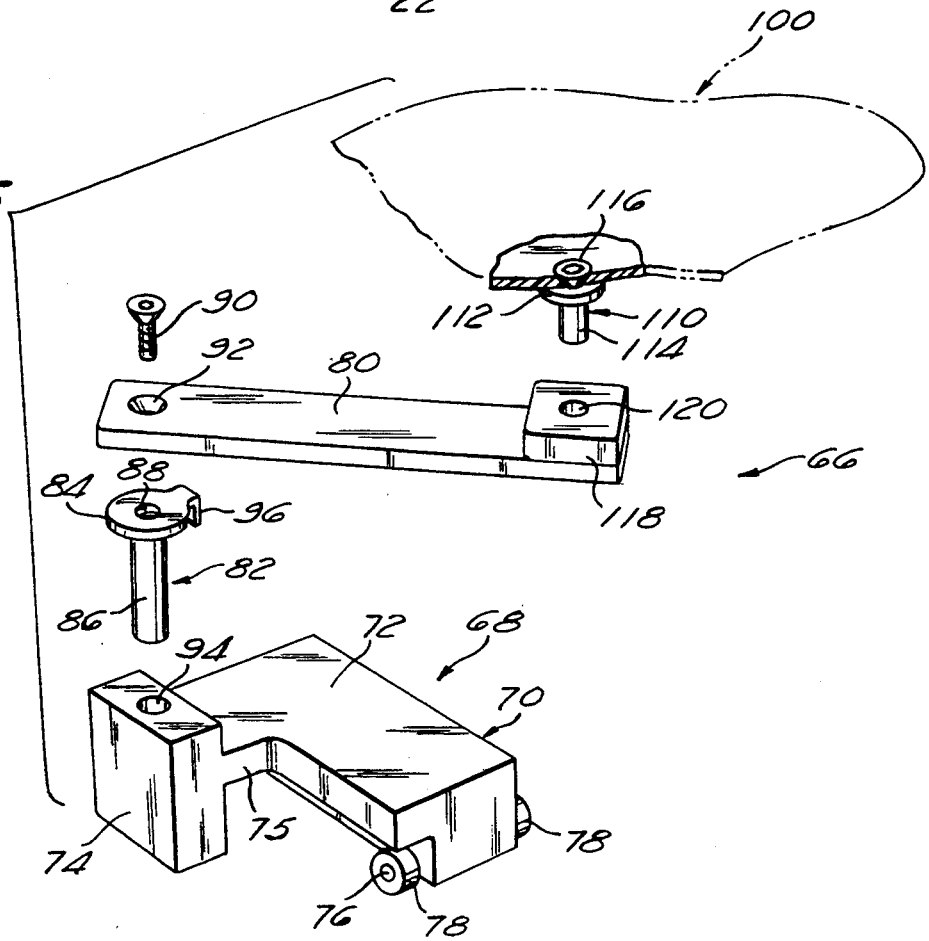

Fig. 6
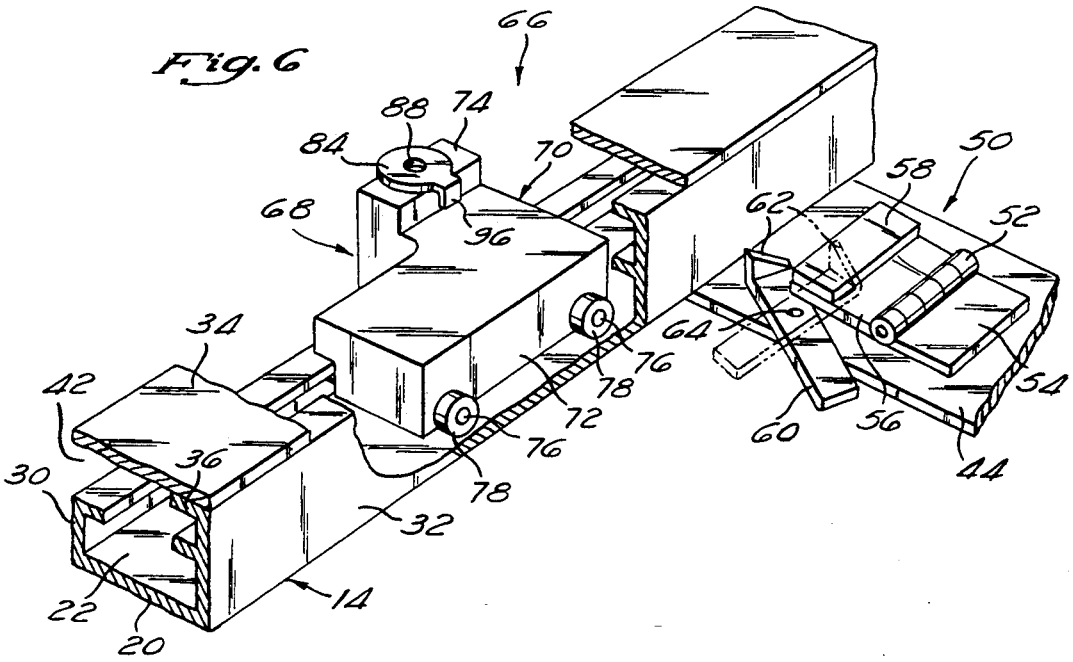
Fig. 7
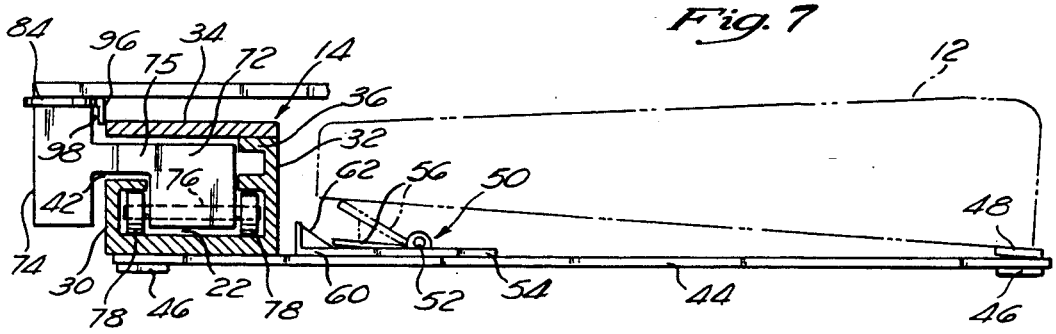
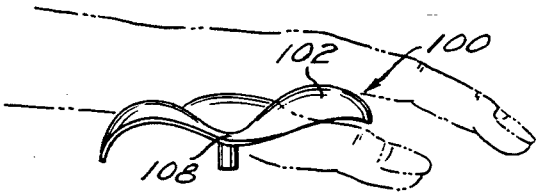
Fig. 8
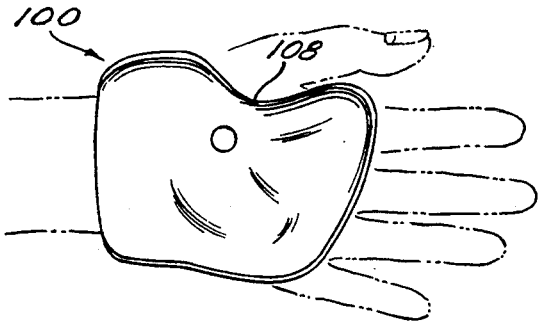
Fig. 9

DYNAMIC SUPPORT DEVICE FOR KEYBOARDS

FIELD OF THE INVENTION

The present invention relates generally to office equipment, and more particularly to a device for dynamically supporting portions of the forearms, wrists and hands of an individual during the use of a keyboard associated with a conventional video display terminal.

Background of the Invention

Recently, investigations conducted by the National Institute for Occupational Safety and Health and various world-wide studies have demonstrated elevated occurrences of musculoskeletal discomforts and disorders in video display terminal (VDT) operators as compared with non-VDT workers. Statistics from these investigations and studies have shown a correlation between VDT use and shoulder, neck discomfort/pain and wrist tendinitis. However, one of the most serious of the newly emerging disorders revealed from the studies is referred to as repetitive strain injury (RSI) or cumulative trauma disorder. A form of RSI is commonly known as carpel tunnel syndrome.

RSI is believed to occur when a person repeats the same motion thousands of times a day. Such repeated motion typically occurs in conjunction with those professions associated with prolonged or continuous use of video display terminal keyboards, i.e. where the individual is required to type much of the day. Examples of such professions include but are not limited to secretaries and data processing personnel. The studies have concluded that when working on a video display terminal keyboard for prolonged periods of time, the tendons of the user's wrists will oftentimes become inflamed and put pressure on the median nerve which resides in the area of the wrist known as the carpel tunnel. Because the VDT operator is conducting the same repetitive motions thousands of times a day when continuously typing, the injury process to which the tendons are subjected from such repeated movements constantly progresses since no opportunity is given for a natural healing process to occur. The pressure caused to the median nerve by the inflamed tendons typically causes symptoms of numbness in the fingers or severe burning sensations in the wrists, oftentimes necessitating corrective surgery to eliminate the discomfort to the individual.

In recent years, researchers have been conducting studies to determine various methods of preventing occurrences of RSI in VDT operators. In this respect, various computer manufacturers have begun to design equipment which is intended to lower the probability of an operator developing RSI by improving the operator's position relative the VDT workstation so as to minimize stress on the wrists, forearms and shoulders. Such enhancements include the use of arm rests, wrist rests and foot rests in conjunction with the VDT workstation. Additionally, the computer screens and keyboards of the workstation are typically designed to be raised or lowered by the VDT operator. In addition to the aforementioned equipment modifications, VDT operators are also trained to use easier and lighter key strokes and to take more frequent rests. Indeed, the consensus of the National Institute for Occupational Safety and Health, the World Health Organization, and the American National Standards Institute is that the use of adjustable VDT workstations in combination with training on proper adjustment of the work station and periodic VDT use during the work day substantially contributes to suitable working postures which in turn provides a safer working environment for the VDT operator.

In December of 1990, the City of San Francisco enacted a VIDEO DISPLAY TERMINAL WORKERS SAFETY ORDINANCE to benefit employees whose duties include routinely performing repetitive keyboard motions four hours or more, inclusive of breaks, per shift. The ordinance makes it mandatory for employers to provide such operators with user-adjustable workstations and chairs that meet various minimum standards. Such standards include the provision of arm rests, wrist rests, and foot rests upon operator request which would enable the operator to maintain a neutral position of the wrist while at the VDT workstation keyboard.

Since estimates place the number of Americans who work on computers, i.e. VDT's, to be approximately seventy-five million, the need for providing various equipment enhancements to the VDT workstation to eliminate occurrences of RSI is of increasing importance.

In recognition of this need, Applicant previously developed the support device disclosed in U.S. Pat. No. 5,161,760 entitled MOVABLE KEYBOARD FOREARM, WRIST AND HAND SUPPORT DEVICE, the disclosure of which is expressly incorporated herein by reference. The device disclosed in the '760 Patent generally comprises a keyboard supporting frame which includes a pair of support members connected thereto in a manner allowing relative movement of each of the support members relative the frame in both longitudinal and lateral directions. The support members are connected to the frame by a pair of elongate carriage members, each of which comprises a guide member having an insert member slidably connected thereto in telescoping fashion, thus allowing the insert member to be extendable or retractable relative the guide member. Each guide member also includes a support wheel for providing a rolling engagement between the carriage members and the frame. Each of the support members comprises a base member having a handle member pivotally connected thereto. The base member is sized and configured to support portions of a user's forearm and wrist, while the handle member is adapted to provide support to the palmar surface of the user's hand. Each support member further includes a biasing means to maintain the handle member against the palmar surface of the user's hand which preferably comprises a leaf spring attached to the lower surface of the base member. As such, the support members are adapted to support portions of the user's forearms, wrists, and hands thereon in a manner reducing the stress on the shoulders, arms, wrists and hands of the user while facilitating the longitudinal and lateral movement needed to fully access the keyboard.

Though the support device disclosed in the '760 Patent addresses and alleviates the deficiencies associated with prior art support devices for VDT operators, the relatively large number of components comprising the carriage members and the support members makes the assembly of the support device both difficult and time-consuming, and hence costly. In addition to increasing the cost of manufacture, the numerous components comprising the support members and carriage members present difficulties in relation to the mass production of the support device, and also make the device more susceptible to breakage. The present invention addresses these concerns by providing a movable dynamic keyboard forearm, wrist and hand support device for use in conjunction with a keyboard of a VDT workstation which is adapted to decrease occurrences of RSI in VDT operators and is constructed in a manner adapted to facilitate increased efficiency in the associated manufacturing process.

SUMMARY OF THE INVENTION

In accordance with the preferred embodiment of the present invention, there is provided a dynamic keyboard forearm, wrist and hand support device for use in conjunction with the keyboard of a video display terminal workstation. The device generally comprises an elongate guide track having a pair of elongate support arms pivotally connected thereto which are selectively extensible into generally perpendicular relation to the track and are sized and configured to support a keyboard when extended. Each of the support arms preferably includes an adjustment mechanism attached thereto for selectively adjusting the height of the keyboard relative the guide track. In the preferred embodiment, each adjustment mechanism comprises a hinge member having a first half rigidly secured to the support arm and a second half pivotally movable in an upward direction away from the support arm. Rotatably connected to the support arm is an elongate swing arm which defines a camming surface adjacent one end thereof. The rotation of the swing arm in a first direction causes the camming surface to engage the hinge member in a manner causing the second half to be pivoted upwardly away from the support arm and thus raise the level of the keyboard. Conversely, the rotation of the swing arm in a second direction causes the camming surface to be disengaged from the hinge member in a manner causing the second half to abut the support arm, thus lowering the level of the keyboard.

The support device further comprises a pair of support assemblies which are connected to the guide track and adapted to support a user's forearms, wrists and hands thereon. In the preferred embodiment, each of the support assemblies comprises a carriage member which is slidably engaged to the guide track and movable longitudinally therealong. The carriage member itself comprises a housing defining first, second and central portions and a pair of axle members extending laterally through the first portion of the housing in substantially parallel relation. Attached to the opposed ends of the axle members are first and second pairs of rollers or wheels. To accommodate the carriage members, the guide track defines a pair of elongate recesses which extend in substantially parallel relation and are sized to slidably receive the first and second pairs of wheels. The guide track is further configured in a manner wherein the first portion of the housing resides therewithin when the first and second pairs of wheels are received into the recesses, with the second portion of the housing extending outwardly therefrom. Pivotally connected to the carriage member, and more particularly to the second portion of the housing, is a linkage member, while pivotally connected to the linkage member is a support member preferably formed of unitary construction and specifically sized and configured to support the user's forearm and wrist as well as the palmar surface of the user's hand. The pivotal connection of the carriage member and the support member to the linkage member and the slidable engagement of the carriage member to the guide track facilitates dynamic lateral and longitudinal movement of the support member relative the track.

In the preferred embodiment, the pivotal connection of the linkage member to the housing is facilitated by a first pin member having a top end rigidly attached to the linkage member and a bottom end slidably receivable into a complimentary aperture disposed within the second portion of the housing. The top end of the first pin member includes a downwardly extending tab formed thereon which is used to limit the pivotal movement of the linkage member relative the housing. In this respect, the pivotal movement of the linkage member relative the housing is limited by the abutment of the tab member against the second portion thereof. The pivotal connection of the support member to the linkage member is facilitated by a second pin member having a top end rigidly attached to the support member and a bottom end slidably receivable into a complimentary aperture disposed within the linkage member.

BRIEF DESCRIPTION OF THE DRAWINGS

These as well as other features of the present invention will become more apparent upon reference to the drawings wherein:

FIG. 1 is a front perspective view of the support device constructed in accordance with the present invention, illustrating a keyboard positioned thereon;

FIG. 2 is a rear perspective view of the support device of the present invention;

FIG. 3 is a top view of the support device of the present invention illustrating the support members in various positions;

FIG. 4 is a partial perspective view illustrating the engagement of a support assembly to the guide track of the present invention;

FIG. 5 is an exploded view illustrating the components comprising each of the two support assemblies;

FIG. 6 is a partial perspective view illustrating the engagement of the carriage member to the guide track and the structure of each adjustment mechanism for raising the height of the keyboard;

FIG. 7 is a cross-sectional view illustrating the engagement of the carriage member to the guide track and the use of an adjustment mechanism to raise the height of the keyboard;

FIG. 8 is a side elevational view illustrating the manner in which each support member supports the forearm, wrist and palmar surface of the user's hand;

FIG. 9 is a bottom view illustrating the manner in which each support member supports the forearm, wrist and palmar surface of the user's hand;

DETAILED DESCRIPTION OF THE PREFERRED EMBODIMENT

Figure 10:
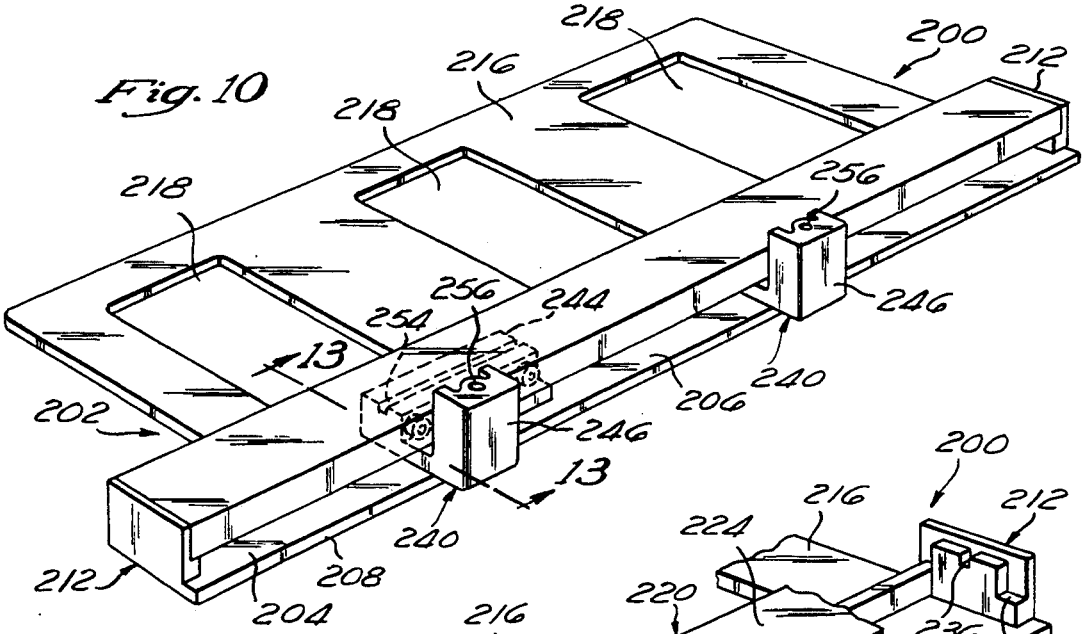
FIG. 10 is a front perspective view of a guide track and carriage members constructed in accordance with a second embodiment of the present invention.

Referring now to the drawings wherein the showings are for purposes of illustrating a preferred embodiment of the present invention, and not for purposes of limiting the same, FIG. 1 perspectively illustrates the keyboard forearm, wrist and hand support device 10 of the present invention having a conventional keyboard 12 (shown in phantom lines) associated with a conventional video display terminal workstation (not shown).

As seen in FIGS. 1, 2, 4, 6 and 7, the support device 10 generally comprises an elongate guide track 14 having a generally rectangular configuration and defining opposed first and second ends 16, 18. In the preferred embodiment, the guide track 14 itself comprises a lower section 20 formed of extruded aluminum or plastic and defining a pair of elongate recesses 22 which extend longitudinally along the length thereof in opposed, substantially parallel relation. The first and second ends 16, 18 of the guide track 14 are defined by a pair of end plates 24 rigidly attached to the opposed ends of the lower section 20. As best seen in FIG. 4, secured to the inner surfaces of each of the end plates 24 is a bumper member 26 formed of a hard plastic or rubber material which is formed to extend into each of the recesses 22. Each of the bumper members 26 is maintained in position via a pair of fasteners such as screws 28 which are extended through the front wall 30 and back wall 32 of the lower section 20 into the bumper member 26.

The guide track 14 further comprises an upper section or plate 34 which is also preferably formed of aluminum or plastic material and is sized having a width substantially equal to the width of the lower section 20. As best seen in FIGS. 6 and 7, the upper section 34 is positioned upon the top surface of a flange 36 extending inwardly from the upper edge of the back wall 32 and is rigidly secured to each of the bumper members 26 or ends 16 and 18 via fasteners such as screws 38 which are extended therethrough and into corresponding internally threaded apertures 40 disposed within each of the bumper members 26. Since the height of the back wall 32 of the lower section 20 exceeds the height of the front wall 30 thereof, when the upper section 34 is rigidly secured to the lower section 20 in the aforementioned manner, a gap or channel 42 of substantially uniform width is defined between the front wall 30 and the upper section 34 which extends horizontally between the end plates 24 of the guide track 14.

Pivotally connected to the guide track 14, and more particularly to the bottom surface of the lower section 20, are preferably a pair of elongate, rectangularly configured support arms 44. The support arms 44, which extend in substantially parallel relation to the bottom surface of the lower section 20 when in the folded or retracted position, are selectively extensible into generally perpendicular relation to the back wall 32 of the lower section 20, and are sized and configured to support the keyboard 12 when extended, as seen in FIGS. 1 and 7. Disposed on the bottom surfaces of each of the support arms 44 adjacent the proximal and distal ends thereof are rubber pads 46 which are used to prevent scratching or other damage to the support surface upon which the support device 10 and accompanying keyboard 12 are rested. As seen in FIG. 2, rubber pads 48 are also disposed on the top surfaces of the support arms 44 adjacent the distal ends thereof to prevent the keyboard 12 residing thereon from sliding. Like the lower and upper sections 20, 34 of the guide track 14, the support arms 44 are also preferably fabricated from extruded aluminum.

Referring now to FIGS. 2, 6 and 7, each of the support arms 44 preferably includes an adjustment mechanism 50 attached to the upper surface thereof for selectively adjusting the height of the keyboard 12 relative to the guide track 14. In the preferred embodiment, each adjustment mechanism 50 comprises a hinge member 52 having a first half 54 rigidly secured to the upper surface of the support arm 44 and a second half 56 which is pivotally movable in an upward direction away from the upper surface of the support arm 44. Importantly, each hinge member 52 is attached to a respective support arm 44 such that the second half 56 is disposed in closer proximity to the back wall 32 of the lower section 20 than is the first half 54. Attached to the upper surface of the second half 56 along the back edge thereof is a rubber pad 58 which is also utilized to prevent the keyboard 12 resting thereupon from sliding.

Each adjustment mechanism 50 further comprises an elongate swing arm 60 which is rotatably connected to the support arm 44 adjacent the second half 56 of the hinge member 52. In the preferred embodiment, each swing arm 60 defines an angled camming surface 62 adjacent one end thereof which is engageable to the second half 56 of the hinge member 52 when the swing arm 60 is rotated. In this respect, the rotation of the swing arm 60 in a first direction causes the camming surface 62 to engage the hinge member 52 in a manner causing the second half 56 to be pushed or pivoted upwardly away from the upper surface of the support arm 44. Conversely, the rotation of the swing arm 60 in a second direction opposite the first direction causes the camming surface 62 to be disengaged from the hinge member 52 thus causing the second half 56 to return to abutting contact with the upper surface of the support arm 44 due to the weight exerted thereupon by the keyboard 12. Due to the orientations of the swing arms 60 upon the support arms 44 as seen in FIG. 2, the swing arm 60 disposed closest the first end 16 must be rotated in a clockwise direction to raise the second half 56 of the hinge member 52, while the swing arm 60 disposed closest the second end 18 must be rotated in a counterclockwise direction to raise the second half 56 of the associated hinge member 52. Each swing arm 60 is pivotally connected to a respective support arm 44 via a centrally positioned pivot pin 64.

Referring now to FIGS. 4–6, the support device 10 constructed in accordance with the present invention further comprises a pair of identically configured support assemblies 66 which are adapted to support a user's forearms, wrists and hands thereon. In the preferred embodiment, each of the support assemblies 66 comprises a carriage member 68 which is slidably engaged to the guide track 14 and movable longitudinally therealong. Each carriage member 68 preferably comprises a unitary housing 70 defining a first horizontally oriented portion 72, a second vertically oriented portion 74 and a middle portion 75 extending between the first and second portions 72, 74. Extending laterally through the first portion 72 of the housing 70 in spaced, substantially parallel relation are a pair of elongate axle members 76. Attached to the opposed ends of the axle members 76 are first and second pairs of rollers or wheels 78. As best seen in FIG. 7, each carriage member 68 is slidably engaged to the guide track 14 via the receipt of the wheels 78 into the opposed pair of recesses 22 defined within the lower section 20 of the guide track 14. As will be recognized, the carriage members 68 are engaged to the guide track 14 prior to the attachment of the upper section 34 to the lower section 20, and the attachment of at least one of the end plates 24 to the lower section 20. Due to the configuration of the housing 70, when the wheels 78 are inserted into the recesses 22, the first portion 72 resides within the lower section 20 of the guide track 14, with the second portion 74 being disposed outboard of the guide track 14. In this respect, when the end plates 24 and the upper section 34 are attached to the lower section 20, the first portion 72 of each carriage member 68 is confined within the lower section 20, with the middle portion 75 being extended through the gap 42 and the second portion 74 partially overlapping the front wall 30 of the lower section 20. Each housing 70 is preferably fabricated from aluminum or a rigid plastic material.

In addition to the carriage members 68, each of the support assemblies 66 further comprises an elongate linkage member 80 which is pivotally connected to the carriage member 68, and more particularly to the exposed second portion 74 of the housing 70. The linkage member 80 has an elongate, generally rectangular configuration and is preferably fabricated from aluminum or plastic. In the preferred embodiment, one end of the linkage member 80 is pivotally connected to the second portion 74 of the housing 70 via a first pin member 82. As best seen in FIGS. 4 and 5, the first pin member 82 includes a circularly configured top end 84 and a cylindrically configured bottom end 86. Extending axially through the top end 84 and downwardly into the bottom end 86 is an internally threaded aperture 88. The linkage member 80 is rigidly attached to the top end 84 of the first pin member 82 via the extension of a fastener such as a screw 90 through a chamfered aperture 92 disposed with the linkage member 80 and into the aperture 88 of the first pin member 82. To facilitate the pivotal engagement of the linkage member 80 to the second portion 74, the cylindrical bottom end 86 of the first pin member 82 is slidably inserted into a complimentary aperture 94 disposed and extending downwardly within the second portion 74 of the housing 70.

The first pin member 82, in addition to facilitating the pivotal connection of the linkage member 80 to the carriage member 68, is preferably adapted to limit the pivotal or rotational movement of the linkage member 80 relative the housing 70. In this respect, each pin member 82 includes a tab 96 formed on and extending downwardly from the top end 84 thereof. As best seen in FIG. 6, each support assembly 66 is assembled in a manner wherein the tab 96 extends downwardly toward the middle portion 75 of the housing 70 and overlaps the second portion 74 thereof when the bottom end 86 of the first pin member 82 is fully received into the aperture 88, i.e. the bottom surface of the circular top end 84 is abutted against the top surface of the second portion 74. Additionally, as seen in FIG. 7, the tab 96 is formed on the top end 84 in a manner wherein a narrow gap 98 is defined between the tab 96 and the second portion 74 when the bottom end 86 is fully received into the aperture 88. As will be recognized, due to the sizing and orientation of the tab 96 relative the second portion 74 of the housing 70, the rotation of the linkage member 80 in clockwise or counterclockwise directions is limited by the abutment of the opposed vertical edges of the tab 96 against the inner surface of the second portion 74. The advantages attendant to the limitation of the pivotal movement of the linkage member 80 relative the housing 70 will be discussed below.

In addition to the carriage member 68 and linkage member 80, each support assembly 66 further comprises a support member 100 which is pivotally connected to the end of the linkage member 80 opposite that rigidly attached to the first pin member 82. In the preferred embodiment, each of the support members 100 comprises a unitary structure formed of a plastic material which is specifically sized and configured to support the user's forearm and wrist, as well as the palmar surface of the user's hand. Particularly, as seen in FIGS. 1, 2, 4, 8 and 9, each of the support members 100 defines an upwardly bowed frontal portion 102 which is sized and configured to extend along and provide support to the palmar surface of the user's hand when the same is rested upon the support member 100. Each support member 100 further defines a downwardly bowed, arcuately contoured rear portion 104 which is sized and configured to accommodate the user's wrist and a portion of the user's forearm when the palmar surface of the hand is rested upon the raised frontal portion 102. In the preferred embodiment, the lateral sides of the frontal portion 102 and rear portion 104 define an upwardly turned, continuous wall region 106 which is adapted to extend along the lateral aspects of the user's forearm, wrist and hand when the same is rested upon the support member 100. However, defined between the medial sides of the frontal and rear portions 102, 104 is an inwardly bowed, arcuately contoured recess 108 which is adapted to accommodate the thumb of the user's hand and allow the same to extend inwardly or medially from the support member 100 in an unrestricted fashion. As such, since the frontal portion 102 does not extend into contact with the bottoms of the user's fingers, and neither the frontal or rear portions 102, 104 extend underneath the user's thumb, the movement of each of the user's fingers is entirely unrestricted, though the palmar surface, wrist and forearm of the user's hand are fully supported. Though not shown, the hand, wrist, and forearm contacting surfaces of the frontal portion 102, rear portion 104, wall region 106, and contoured recess 108 of each support member 100 may be provided with a layer of padding or cushioning material thereupon, to facilitate increased user comfort.

As will be recognized, the support members 100, though identically contoured, are formed as mirror images of one another to accommodate the left and right hands of the user. In this respect, the support member 100 used to accommodate the left hand of the user will be formed and attached to its associated linkage member 80 such that the lateral wall region 106 thereof is normally disposed in closer proximity to the first end 16 than is the arcuate recess 108 thereof. Similarly, the support member 100 used to accommodate the right hand of the user will be formed and pivotally connected to its associated linkage member 80 in a manner wherein the lateral wall region 106 thereof is normally disposed in closer proximity to the second end 18 of the guide track 14 than is the arcuate recess 108 thereof. These relative positionings of the support members 100 are depicted in FIG. 3.

As seen in FIG. 5, the pivotal connection of each support member 100 to its associated linkage member 80 is facilitated by a second pin member 110. Similar to the first pin member 82 previously described, each second pin member 110 defines a circularly configured top end 112 and a cylindrically configured bottom end 114.

Extending axially through the top end 112 and downwardly into the bottom end 114 is an internally threaded aperture (not shown). Each support member 100 is rigidly attached to the top end 112 of its associated second pin member 110 via the extension of a fastener such as a screw 116 therethrough and into the internally threaded aperture of the second pin member 110. The pivotal connection of the support member 100 to the linkage member 80 is achieved by the slidable receipt of the cylindrical bottom end 114 of the second pin member 110 into a complimentary aperture disposed within the linkage member 80. In the preferred embodiment, positioned intermediate the linkage member 80 and the support member 100 is a spacer element 118 which is formed from nylon or a similar material, and is attached to the upper surface of the linkage member 80. Extending through the spacer element 118 is an aperture 120 which has the same diameter as and is co-axially aligned with the pin member receiving aperture of the linkage member 80 when the spacer element 118 is attached to the upper surface thereof. As such, in connecting the support member 100 to the linkage member 80, the bottom end 114 of the second pin member 110 is initially extended through the aperture 120 of the spacer element 118 prior to being extended through the linkage member 80. Since the top end 112 of the second pin member 110 includes no tab formed thereon, each support member 100 is freely rotatable relative its associated linkage member 80.

The support device 10 is initially set-up by extending each of the support arms 44 perpendicularly relative the guide track 14 thus causing the support arms 44 to assume the orientations shown in FIG. 2. Thereafter, the keyboard 12 is positioned upon the extended support arms 44 in a manner wherein the guide track 14 extends along the front edge thereof as shown in FIG. 1. Subsequent to the positioning of the keyboard 12 upon the support arms 44, the adjustment mechanisms 50 may be selectively manipulated to position the keyboard 12 at a desired level relative the guide track 14. After the height of the keyboard 12 has been adjusted, the user's hands are placed upon the support members 100 as shown in FIGS. 8 and 9 such that the lateral aspect of each hand extends along the wall region 106 of a respective support member 100, with the user's thumb extending inwardly or medially from the support member 100 through the arcuate recess 108 thereof.

Through the utilization of the support device 10, portions of the user's forearms, wrists and hands are supported adjacent the keyboard 12 associated with the video display terminal work station. Due to the pivotal connection of the carriage members 68 and support members 100 to the linkage members 80 and the slidable engagement of the carriage members 68 to the guide track 14, the support members 100, and hence the user's hands, are movable both longitudinally and laterally relative the guide track 14. Additionally, since the linkage members 80 are not freely rotatable relative the carriage members 68, the support members 100 are prevented from assuming positions which are outside of the range needed to fully access the keyboard 12. Thus, the work surface of the keyboard 12 is completely accessible to the hands of the user with the support members 100 serving to reduce the stress on the user's shoulders, arms, wrists and hands.

Referring now to FIG. 10, perspectively illustrated is an elongate guide track 200 constructed in accordance with a second embodiment of the present invention, which may be utilized as an alternative to the previously described guide track 14. In the second embodiment, the guide track 200 comprises a lower section 202 formed of plastic and defining a rectangularly configured frontal portion 204. The frontal portion 204 itself defines a generally planar upper surface 206, and front and back edges 208,210 which extend longitudinally in substantially parallel relation. The frontal portion 204 further defines a pair of identically configured end portions 212 which extend upwardly from the opposed transverse edges thereof, and an elongate wall portion 214 which is formed on the upper surface 206 adjacent the back edge 210 and extends between the end portions 212 in substantially parallel relation to the back edge 210. Extending rearwardly from the back edge 210 of the frontal portion 204 is a keyboard support portion 216 which has a generally rectangular configuration and is adapted to support a conventional keyboard upon the upper surface thereof. The keyboard support portion 216 preferably includes three equidistantly spaced, rectangularly configured apertures 218 disposed therein to decrease the overall weight associated with the guide track 200 and the amount of material required to facilitate the same.

Figure 11:
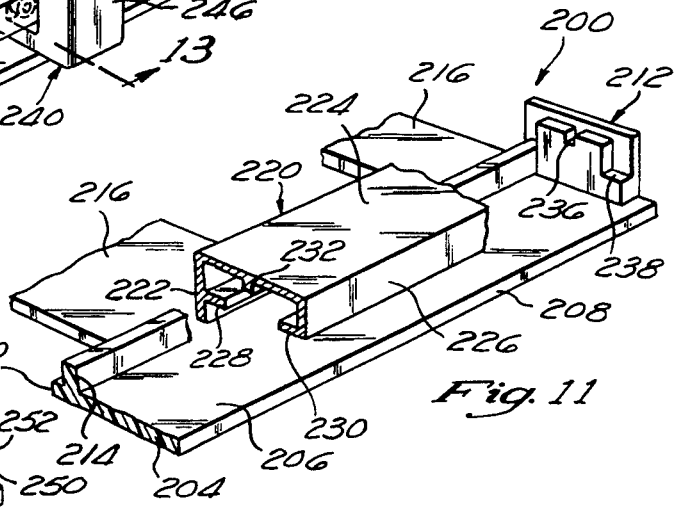
FIG. 11 is a partial perspective view of the guide track constructed in accordance with the second embodiment of the present invention.
Figure 13:
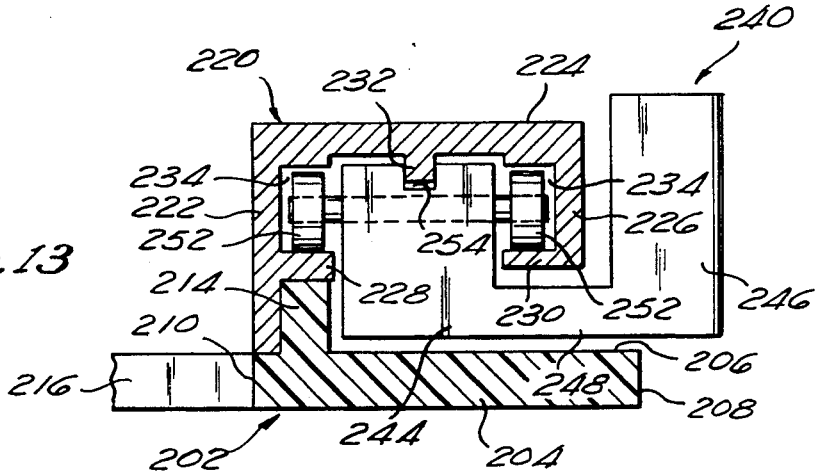
FIG. 13 is a cross-sectional view taken along line 13—13 of FIG. 10.

In addition to the lower section 202, the guide track comprises an upper section 220 which is preferably formed of aluminum and is rigidly attachable to the lower section 202. As best seen in FIGS. 11 and 13, the upper section 220 defines a back wall 222, a top wall 224 and a front wall 226. Extending inwardly from the back wall 222 is a first flange 228, while extending inwardly from the front wall 226 is a second flange 230. Additionally, extending downwardly from the top wall 224 is a third flange 232. The upper section 220 further defines a pair of elongate recesses 234 which extend longitudinally along the length thereof in opposed, substantially parallel relation, with one of the recesses 234 being defined between the first flange 228 and the top wall 224 and the other being defined between the second flange 230 and the top wall 224.

When the upper section 220 is attached to the lower section 202, the wall portion 214 is received into a generally L-shaped recess defined by the lower surface of the first flange 228 and the lower portion of the inner surface of the back wall 222. Additionally, the opposed ends of the third flange 232 are received into complimentary slots 236 formed in the end portions 212, with the opposed ends of the second flange 230 being received into a complimentary pair of L-shaped recesses 238 formed within the end portions 212. As seen in FIG. 13, the thickness of the back wall 222 is such that when the wall portion 214 is received into the recess defined by the back wall 222 and the first flange 228, the outer surface of the back wall 222 is substantially flush with the back edge 210 of the lower section 202. Subsequent to the positioning of the upper section 220 relative the lower section 202 in the aforementioned manner, fasteners such as screws are extended through the lower portion of the back wall 222 and into the wall portion 214 so as to rigidly secure the upper and lower sections 220,202 to each other.

Figure 12:
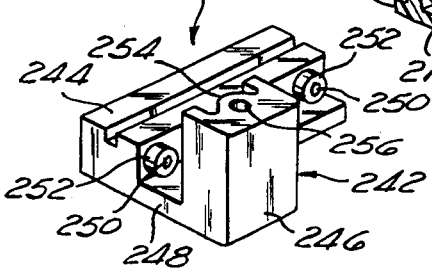
FIG. 12 is a perspective view of a carriage member constructed in accordance with the second embodiment of the present invention.

Referring now to FIGS. 10, 12 and 13, slidably engaged to the guide track 200 and movable longitudinally therealong is a pair of identically configured carriage members 240 which are constructed in accordance with a second embodiment of the present invention. Each of the carriage members 240 comprises a unitary housing 242 defining a first horizontally oriented portion 244, a second vertically oriented portion 246 and a central portion 248 extending between the first and second portions 244, 246. Extending laterally through the first portion 244 of the housing 242 in spaced, substantially parallel relation are a pair of elongate axle members 250. Attached to the opposed ends of the axle members 250 are first and second pairs of rollers or wheels 252. As best seen in FIG. 13, each carriage member 240 is slidably engaged to the guide track 200 via the receipt of the wheels 252 into the opposed pair of recesses 234 defined within the upper section 220. When received into the recesses 234, the wheels 252 are supported upon and roll along the upper surfaces of the first flange 228 and second flange 230. In the guide track 200, the width of the recesses 234, i.e., the distance separating the upper surfaces of the first and second flanges 228, 230 and the top wall 224, is only slightly greater than the outer diameter of the wheels 252, thus preventing the carriage members 240 from tipping within the guide track 200 when downward pressure is applied to the vertically-oriented portion 246 of each of the carriage members 240. Advantageously, the wheels 252 are caused to roll linearly along the upper surfaces of the first and second flanges 228, 230, and thus are prevented from coming into contact with the back and front walls 222, 226, by the slidable receipt of the third flange 232 into an elongate slot 254 extending longitudinally through the upper surface of the first portion 244.

Due to the configuration of the housing 242, when the wheels 252 are inserted into the recesses 234, the first portion 244 resides within the upper section 220 of the guide track 200, with the second portion 246 being disposes outboard of the guide track 200. Additionally, as seen in FIG. 13, the housing 242 is sized such that the bottom surface thereof is maintained in spaced relation from the upper surface 206 of the frontal portion 204. As will be recognized, the carriage members 240 are interfaced to the upper section 220 prior to the rigid attachment thereof to the lower section 202. The subsequent attachment of the upper section 220 to the lower section 202 confines the first portion 244 of each of the carriage members 240 within the upper section 220, with the central portion 248 being extended through the gap defined between the upper surface 206 of the frontal portion 204 and the second flange 230. In the second embodiment, each housing 242 is preferably fabricated from plastic.

Disposed within and extending downwardly into the second portion 246 of each housing 242 is an aperture 256. The apertures 256 of the housings 242 are adapted to receive the previously described first pin members 82 to facilitate the interface of the linkage members 80 and support members 100 to the carriage members 240 in the same manner as previously described with respect to the carriage members 68.

Figure 14:
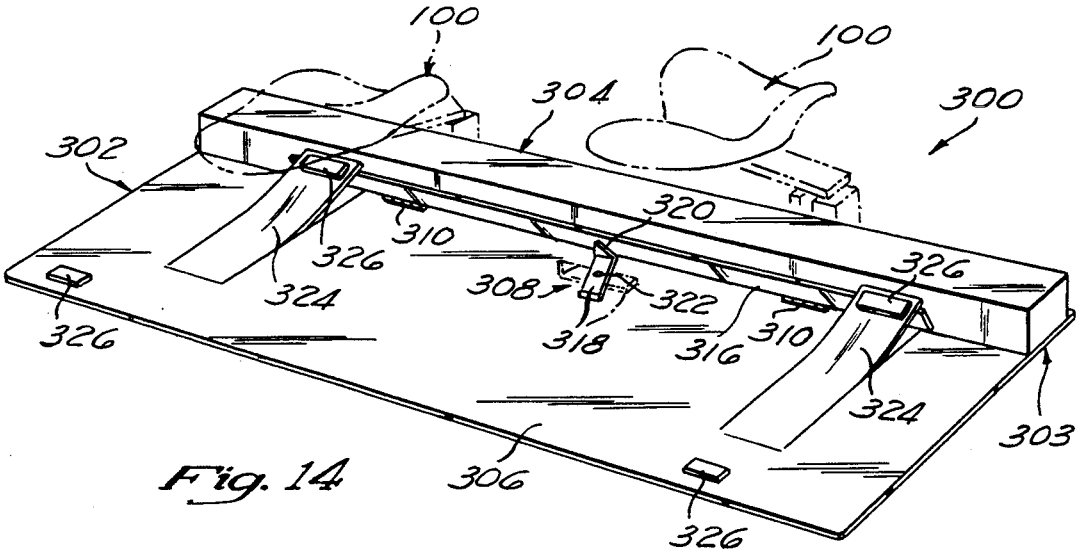
FIG. 14 is a rear perspective view of a guide track constructed in accordance with a third embodiment of the present invention.

Referring now to FIG. 14, perspectively illustrated is an elongate guide track 300 constructed in accordance with a third embodiment of the present invention, which may be utilized as an alternative to the previously-described guide tracks 14, 200. In the third embodiment, the guide track 300 is configured similarly to the guide track 200, and comprises a lower section 302 and an upper section 304. The upper section 304 is identical to the previously-described upper section 220, while the lower section 302 defines a frontal portion 303 configured identically to the frontal portion 204 of the previously-described lower section 202. As such, the attachment of the upper section 304 of the guide track 300 to the lower section 302 is accomplished in the same manner as the attachment of the upper section 220 of the guide track 200 to the lower section 202 thereof.

Extending rearwardly from the frontal portion 303 of the lower section 302 is a keyboard support portion 306 which has a generally rectangular configuration and is adapted to support a conventional keyboard upon the upper surface thereof. In the third embodiment, attached to the upper surface of the keyboard support portion 306 is an adjustment mechanism 308 for selectively adjusting the height of the keyboard relative to the guide track 300. The adjustment mechanism 308 preferably comprises at least one and preferably two hinge members 310, each of which include a first half rigidly secured to the upper surface of the keyboard support portion 306 and a second half which is pivotally movable in an upward direction away from the upper surface of the support portion 306. In particular, each hinge member 310 is attached to the support portion 306 such that the first half is disposed in closer proximity to the frontal portion 303 than is the second half. The adjustment mechanism 308 further comprises an elongate bar member 316 which is attached to the second half of each of the hinge members 310 in a manner wherein the bar member 316 extends longitudinally in substantially parallel relation to the back edge of the frontal portion 303.

In addition to the hinge members 310 and bar member 316, the adjustment mechanism 308 comprises an elongate swing arm 318 which is rotatably connected to the keyboard support portion 306 adjacent the second half 314 of the hinge member 310. The swing arm 318 defines an angled camming surface 320 adjacent one end thereof which is engageable to the bar member 316 when the swing arm 318 is rotated. Due to the pivotal connection of the bar member 316 to the support portion 306 via the hinge members 310, the rotation of the swing arm 318 in a first direction causes the camming surface 320 to engage the bar member 316 in a manner causing the bar member 316 to be pushed or pivoted upwardly away from the upper surface of the support portion 306. Conversely, the rotation of the swing arm 318 in a second direction opposite the first direction causes the camming surface 320 to be disengaged from the bar member 316 thus causing the bar member 316 to return to abutting contact with the upper surface of the support portion 306. Due to the orientation of the swing arm 318 upon the support portion 306 as seen in FIG. 14, the swing arm 318 must be rotated in a clockwise direction to raise the bar member 316. The swing arm 318 is preferably pivotally connected to the support portion 306 via a centrally-positioned pivot pin 322.

In the third embodiment, the keyboard support portion 306 of the guide track 300 includes a pair of elongate, flexible tab portions 324 which extend in opposed, substantially parallel relation to each other and in substantially perpendicular relation to the back edge of the frontal portion 303. The tab portions 324 are rectangularly configured and preferably formed by cutting the support portion 306 in a manner wherein the front end of each of the tab portions 324, i.e., the end disposed in closest proximity to the front portion 303, is pivotally movable relative the remainder of the keyboard support portion 306. In the guide track 300, the front ends of the tab portions 324 are preferably flexed upwardly and extended over the opposed ends of the bar member 316. As such, the upward pivotal movement of the bar member 316 as caused by the rotation of the swing arm 318 causes the front ends of the tab portions 324 to be flexed upwardly relative the remainder of the support portion 306.

Due to the orientation of the tab portions 324, the keyboard is rested upon the front ends thereof when positioned upon the keyboard support portion 306. As such, the height of the keyboard is adjusted by rotating the swing arm 318 which causes the bar member 316, and hence, the front ends of the tab portions 324, to be pivoted upwardly away from the remainder of the support portion 306. Since the keyboard rests upon the front ends of the tab portions 324, the same is elevated when the tab portions 324 are flexed upwardly. To prevent the keyboard from sliding along the tab portions 324, disposed on the top surfaces thereof adjacent the front ends are rubber pads 326. In the third embodiment, rubber pads 326 are also disposed on the upper surface of the support portion 306 adjacent the back ends of the tab portions 324 for purposes of preventing the keyboard from sliding relative the remainder of the support portion 306.

It will be recognized that as an alternative to forming the tab portions 324 by cutting the keyboard support portion 306, the back ends of two elongate, rectangularly configured strips of flexible material may be rigidly affixed to the upper surface of the keyboard support portion 306 such that the front ends of the strips are upwardly pivotal relative thereto. The strips would be attached to the support portion 306 in the same basic orientation as the previously-described tab portions 324. Additionally, though not shown, the keyboard support portion 306 with the tab portions 324 or elongate strips may include one or more apertures or recesses disposed therewithin to decrease the overall weight associated with the guide track 300 and the amount of material required to fabricate the same.

Though, in the support device 10, the guide track 14, 200,300 has a length substantially equalling the length of the keyboard positioned thereupon, and includes a pair of support assemblies engaged thereto, it will be recognized that the support device may alternatively be configured for use with a smaller piece of office equipment, such as a calculator. In this respect, the guide track of such a support device would be shorter than the guide track 14, 200, 300 and would include only a single support assembly engaged thereto. In the support device 10, the configuration of the support assemblies and the manner in which they are engaged to the guide track 14, 200, 300 provides a sufficient range of motion to each of the user's hands so as to allow peripheral equipment disposed adjacent one or both lateral sides of the keyboard, such as a track ball, to be operated while the hands, wrists, and forearms are supported upon the support assemblies. As will be recognized, due to the manner in which the linkage members 80 are engaged to the carriage members 68, 240, such peripheral equipment is most easily accessed by the right hand of the user due to the ability to position the support member 100 of the right-hand support assembly at a location longitudinally beyond the right edge of the keyboard. Finally, it will be recognized that the support device 10 and accompanying keyboard may be provided as a single assembly.

Additional modifications and improvements of the present invention may be apparent to those skilled in the art. Thus, the particular combination of parts described and illustrated herein is intended to represent only one embodiment of the invention and is not intended to serve as limitations of alternative devices within the spirit and scope of the invention.

What is claimed is:

1. A keyboard, forearm, wrist and hand support device, comprising:

an elongate guide track;

a pair of elongate support arms pivotally connected to said guide track and selectively extensible into generally perpendicular relation thereto, set support arms being sized and configured to support the keyboard when fully extended; and a pair of support assemblies adapted to support a user's forearms, wrists and hands thereon, each of said support assemblies comprising:

a carriage member slidabley engaged to said track and movable longitudinally therealong;

a linkage member pivotally connected to said carriage member; and a support member pivotally connected to said linkage member, said support member being sized and configured to support the user's forearm and wrist and the palmar surface of the user's hand;

wherein the pivotal connection of said carriage member and said support member to said linkage member and the slidable engagement of said carriage member to said guide track facilitates dynamic lateral and longitudinal movement of the support member relative the guide track.

2. The device of claim 1 wherein each of said support arms includes an adjustment mechanism attached thereto for selectively adjusting the height of the keyboard relative the guide track.

3. The device of claim 2 wherein each of said adjustment mechanisms comprises:

a hinge member having a first half rigidly secured to said support arm and the second half pivotally movable in an upward direction away from said support arm; and an elongate swing arm connected to said support arm and defining a camming surface adjacent one end thereof;

wherein the rotation of said swing arm in a first direction causes said camming surface to engage said hinge member in a manner causing said second half to be pivoted upwardly away from said support arm, and the rotation of said swing arm in a second direction causes said camming surface to be disengaged from said hinge member in a manner causing said second half to abut said support arm.

4. A keyboard, forearm, wrist and hand support device, comprising:

an elongate guide track; and a pair of support assemblies adapted to support a user's forearms, wrists and hands thereon, each of said support assemblies comprising:

a carriage member slidably engaged to said track and movable longitudinally therealong, said carriage member comprising a housing defining first and second portions, a pair of axle members extending laterally through the first portion of said housing in substantially parallel relation, and first and second pairs of wheels attached to the opposed ends of said axle members;

a linkage member pivotally connected to said carriage member; and a support member pivotally connected to said linkage member, said support member being sized and configured to support the user's forearm and wrist and the palmar surface of the user's hand;

wherein the pivotal connection of said carriage member and said support member to said linkage member and the slidable engagement of said carriage member to said guide track facilitates dynamic lateral and longitudinal of the support member relative the guide track.

5. The device of claim 4 wherein said guide track defines a pair of elongate recesses which extend in substantially parallel relation and are sized to slidably receive said first and second pairs of wheels, said guide track being configured in a manner wherein the first portion of the housing resides therewithin when said first and second pairs of wheels are received into the recesses and the second portion of the housing extends outwardly therefrom.

6. The device of claim 5 wherein said guide track defines opposed inner ends having bumper members attached thereto.

7. The device of claim 5 wherein said linkage member is pivotally connected to the second portion of the housing.

8. The device of claim 7 wherein the pivotal connection of said linkage member to said housing is facilitated by a first pin member having a top end rigidly attached to said linkage member and a bottom end slidably receivable into a complimentary aperture disposed within the second portion of the housing, said top end being sized and configured to limit the pivotal movement of the linkage member relative the housing.

9. The, device of claim 8 wherein the top end of said first pin member includes a downwardly extending tab formed thereon, the pivotal movement of said linkage member relative said housing being limited by the abutment of said tab against the second portion of the housing.

10. The device of claim 5 wherein said guide track comprises an upper section and a lower section, said recesses being defined within said upper section.

11. The device of claim 10 wherein said lower section includes a keyboard support portion extending rearwardly therefrom and configured to support the keyboard thereupon.

12. The device of claim 11 wherein said keyboard support portion includes an adjustment mechanism attached thereto for selectively adjusting the height of the keyboard relative the guide track.

13. The device of claim 12 wherein said adjustment mechanism comprises:

at least one hinge member having a first half rigidly secured to said support portion and a second half pivotally movable in an upward direction away from said support portion;

an elongate swing arm connected to said support portion and defining a camming surface adjacent one end thereof; and an elongate bar member attached to the second half of said hinge member and extending longitudinally in substantially parallel relation to said lower section;

wherein the rotation of said swing arm in a first direction causes said camming surface to engage said bar member in a manner causing said bar member to be pivoted upwardly away from said support portion, and the rotation of said swing arm in a second direction causes said camming surface to be disengaged from said bar member in a manner causing said bar member to abut said support portion.

14. The device of claim 13 wherein said keyboard support portion includes a pair of flexible tab portions having front ends extended over the opposed ends of said bar member.

15. A forearm, wrist and hand support member, comprising:

an upwardly bowed frontal portion adapted to extend along and provide support to the palmar surface of the hand;

a downwardly bowed rear portion adapted to accommodate and provide support to the wrist and a portion of the forearm;

16. A keyboard, forearm, wrist and hand support device, comprising:

an elongate guide track; and a pair of support assemblies adapted to support a user's forearms, wrists and hands thereon, each of said support assemblies comprising:

a carriage member slidabley engaged to said track and movable longitudinally therealong;

a linkage member pivotally connected to said carriage member; and a support member pivotally connected to said linkage member, the pivotal connection of said support member to said linkage member being facilitated by a second pin member having a top end rigidly attached to said support member and a bottom end slidably receivable into a complementary aperture disposed within said linkage member, said support member being sized and configured to support the user's forearm and wrist and the palmar surface of the user's hand;

wherein the pivotal connection of said carriage member and said support member to said linkage member and the slidable engagement of said carriage member to said guide track facilitates dynamic lateral and longitudinal movement of the support member relative the guide track.

17. The device of claim 16 wherein each of said support members comprises:

an upwardly bowed frontal portion adapted to extend along and provide support to the palmar surface of the user's hands; and a downwardly bowed, arcuately contoured rear portion adapted to accommodate and provide support to the user's wrist and a portion of the user's forearm.

* * * * *